US006302772B1

(12) United States Patent
Hosoki et al.

(10) Patent No.: US 6,302,772 B1
(45) Date of Patent: Oct. 16, 2001

(54) APPARATUS AND METHOD FOR DRESSING A WAFER POLISHING PAD

(75) Inventors: Kanji Hosoki; Hiroshi Shibaya; Masahito Komasaki; Jiro Sano; Hiroyuki Kobayashi, all of Omiya (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/538,506

(22) Filed: Mar. 30, 2000

(30) Foreign Application Priority Data

Apr. 1, 1999 (JP) ..... 11-095565
Oct. 4, 1999 (JP) ..... 11-283560

(51) Int. Cl.[7] ..... B24B 1/00

(52) U.S. Cl. ..... 451/56; 451/41; 451/60; 451/287; 451/288; 451/443

(58) Field of Search ..... 451/41, 56, 60, 451/287, 288, 443

(56) References Cited

U.S. PATENT DOCUMENTS 6,120,350 * 9/2000 Zhou et al. ..... 451/21
6,200,199 * 3/2001 Gurusamy et al. ..... 451/56
6,200,207 * 3/2001 Hsu ..... 451/443

* cited by examiner

*Primary Examiner*—Timothy V. Eley
*Assistant Examiner*—Shantese McDonald
(74) *Attorney, Agent, or Firm*—Oblon, Spivak, McClelland, Maier & Neustadt, P.C.

(57) ABSTRACT

An apparatus for dressing a wafer polishing pad, including a disk-shaped dresser, an arm, and a control unit. The disk-shaped dresser is configured to be pressed against the polishing pad which rotates in a circumferential direction. The dresser is configured to rotate in a same direction as the polishing pad rotates due to frictional force generated between the dresser and the polishing pad. The arm is configured to support the dresser rotatably and to press the dresser against the polishing pad. The control unit is configured to control the arm to position the dresser such that a peripheral edge portion of the dresser is positioned outside a peripheral edge portion of the polishing pad by a predetermined distance.

4 Claims, 10 Drawing Sheets

APPARATUS AND METHOD FOR DRESSING A WAFER POLISHING PAD

CROSS-REFERENCE TO RELATED APPLICATIONS

The present application claims priority under 35 U.S.C. §119 to Japanese Patent Applications No. HEI 11-095565, filed Apr. 1, 1999 and No. HEI 11-283560, filed Oct. 4, 1999. The contents of these applications are incorporated herein by reference in their entirety.

BACKGROUND OF THE INVENTION

1. Field of the Invention

The present invention relates to an apparatus and a method for dressing a polishing pad for use in a wafer polishing apparatus.

2. Description of the Related Art

A rotary wafer polishing apparatus for polishing surfaces of semiconductor wafers is generally constructed as follows. A wafer polishing head for holding a wafer and a platen including a polishing pad affixed to the platen are arranged in opposed relation. The polishing pad is rotated while the surface of the wafer is pressed against the polishing pad and a slurry containing polishing abrasive grains is supplied. Simultaneously, the wafer polishing head is rotated to perform planetary or oscillatory motion on the polishing pad, whereby the wafer is polished.

It is known in the above wafer polishing apparatus that repeating the process of polishing a wafer reduces roughness of the polishing pad and gradually deteriorates the polishing performance. For this reason, each time the wafer polishing process is finished, the polishing pad is dressed by using polishing-pad dressing apparatus as shown in FIG. 7.

Referring to FIG. 7, the dressing apparatus comprises a dresser 11 affixed to a dresser support 10, and an arm 12 for supporting the dresser 11 rotatably in the circumferential direction with a dressing surface 11*a* facing downward. A ball joint (not shown) is provided at a joint portion between the arm 12 and the dresser support 10 so that the dressing surface 11*a* of the dresser 11 is held parallel to a polishing pad 14 regardless of an angle at which the arm 12 inclines. Also, the dresser 11 is movable in the vertical and horizontal directions toward or away from the polishing pad 14 affixed to a platen 13 with operation of an arm elevating/lowering mechanism and an arm advancing/retracting mechanism (both not shown) which are coupled to a base end of the arm 12.

In the above dressing apparatus, by rotating the polishing pad 14 while the dresser 11 is pressed against the polishing pad 14, frictional force generated between the dresser 11 and the polishing pad 14 causes the dresser 11 to rotate in the same direction as the polishing pad 14, and brings the dresser 11 into slide contact with the surface of the polishing pad 14. As a result, the surface of the polishing pad 14 is dressed.

However, a conventional dressing apparatus has such a tendency that the amount of dressing (i.e., the amount by which the polishing pad is dressed) in each step of dressing increases gradually, though by small degrees, toward the center of the polishing pad. In other words, each time the polishing pad is subjected to dressing, the surface of the polishing pad is cut in the form conically recessed toward the center, and an extent of excessive cutting on the inner side increases gradually.

The reason is thought to reside in that a dresser is arranged to locate entirely within an area covered by the radius R of the polishing pad when viewed from above vertically.

On condition that the contact pressure of the dresser is uniform, the amount of dressing of the polishing pad is determined depending on a sliding length of dresser abrasive grains at radial positions of the polishing pad, as seen from the following formula (I):

$$z(x)=k\cdot L(x)\cdot P(x) \quad \text{(I)}$$

z(x): amount of dressing at position spaced distance x from the center of the polishing pad k: proportional coefficient L(x): sliding length of abrasive grains at position spaced distance x from the center of the polishing pad P(x): contact pressure of the dresser at position spaced distance x from the center of the polishing pad Further, the sliding length L(x) is determined depending on the rotational speed of the dresser, the surface configuration of the dresser abrasive grains, and the density of the dresser abrasive grains. Usually, the sliding length L(x) tends to have a larger value in an area closer to the center of the polishing pad.

In the conventional dressing apparatus, because the dresser is arranged to locate entirely within an area covered by the radius R of the polishing pad, the contact pressure of the dresser against the polishing pad is substantially uniform. As seen from the formula (1), therefore, the amount of dressing is increased on the inner peripheral side of the polishing pad in which the sliding length of the abrasive grains is comparatively long, thus resulting in a phenomenon of inner-side excessive cutting. Accordingly, repeating the dressing increases gradually a minus gradient of the surface configuration of the polishing pad toward the center from the outer periphery thereof, and hence increases the gradient of the pad surface in the conically recessed form.

This eventually raises a problem of impairing uniformity in each wafer polishing process.

Such a variation of uniformity in each wafer polishing process has been hitherto regarded to be so small as falling in sufficiently allowable range, but a demand for higher uniformity has become keen in recent years.

At present, the above problem is dealt with, for example, by frequently replacing the polishing pad with a fresh one. This solution however gives rise to the secondary problems that an operation cost is pushed up and the operation must be suspended for a while for replacement of the polishing pad.

Moreover, in the conventional dressing apparatus, because the dressing surface of a dresser is clogged with pad chippings cut by the dresser and slurry particles during the dressing of a polishing pad, the polishing pad is unevenly dressed. Accordingly, the machining accuracy of a wafer polished by the polishing pad deteriorates.

At present, therefore, the above problem is dealt with by cleaning the dresser after being used for the dressing, for example, with a method of spraying pure water to the dressing surface of the dresser or keeping the dresser in water to rinse the dressing surface. However, the problem of clogging of the dresser occurred during the dressing cannot be overcome at the current state of the art.

SUMMARY OF THE INVENTION

In view of the above-described situations in the art, an object of the present invention is to provide an apparatus and a method for dressing a wafer polishing pad, which can hold uniform the amount of dressing of the polishing pad at any radial positions, and can prevent a phenomenon of inner-side or outer-side excessive cutting of the polishing pad from progressing gradually, thereby improving uniformity in each wafer polishing process. Another object of the present invention is to provide an apparatus and a method for dressing a wafer polishing pad, which can effectively prevent clogging of a dresser to make the polishing pad dressed uniformly, and can improve the machining accuracy of a wafer.

The above objects are achieved by providing an apparatus for dressing a wafer polishing pad, which is constructed as follows. Specifically, the present invention provides an apparatus for dressing a wafer polishing pad, in which a disk-shaped dresser is pressed from above against a circular polishing pad rotating in a circumferential direction, and the dresser is rotated in the same direction as the polishing pad due to frictional force generated between the dresser and the polishing pad, thereby dressing a surface of the polishing pad, the dressing apparatus comprising an arm for supporting the dresser rotatably and pressing the dresser against the polishing pad from above, and a control unit for controlling operation of the arm and arranging a peripheral edge portion of the dresser to shift off a predetermined distance radially outward of the polishing pad from an entirely overlapped relation.

When the dresser is pressed against the polishing pad, the polishing pad imposes reaction forces acting upon contact portions of the dressing surface of the dresser. By shifting the dresser in the radially outward direction of the polishing pad such that the peripheral edge portion of the dresser lies off the predetermined distance from the entirely overlapped relation with respect to the polishing pad, while maintaining a state of the dresser covering a part of annular area of the polishing pad to be dressed, the reaction forces acting upon the dresser are out of balance. This produces a moment acting upon the dresser to push the peripheral edge portion of the dresser, which is positioned on the side near the center of the polishing pad, upward in a vertical plane aligned with the radial direction of the polishing pad. As a result, under cooperation with the action of a ball joint provided between the arm and the dresser, the dresser is forced to incline slightly so as to raise the peripheral edge portion of the dresser which is positioned on the center side of the polishing pad. With such an inclination of the dresser, a contact pressure of the dresser against the surface of the polishing pad increases gradually toward the outer periphery from the center of the polishing pad.

With the present invention, such an inherent characteristic of the dressing process that repeating the dressing increases a minus gradient of the surface configuration of the polishing pad toward the center from the outer periphery thereof can be canceled by setting the contact pressure of the dresser to increase gradually toward the outer periphery from the center of the polishing pad. Consequently, the amount of dressing of the polishing pad is held uniform in the radial direction.

As the shift-off amount (distance) of the dresser is increased, the reaction forces acting upon the dresser are out of balance to a larger extent and the dresser is inclined at a greater angle. Correspondingly, the plus gradient in distribution of the contact pressure of the dresser becomes greater than required, and the polishing pad is eventually cut into the conical form projecting at the center (called outer-side excessive cutting).

It is hence understood that there is a proper position at which the dresser is to be arranged to shift off radially outward of the polishing pad from an entirely overlapped relation. In the present invention, therefore, the shift-off amount of the dresser is set to a proper value so that the inner-side or outer-side excessive cutting of the polishing pad can be avoided from progressing gradually and the amount of dressing of the polishing pad can be held uniform in the radial direction.

Further, in the above apparatus for dressing a wafer polishing pad according to the present invention, the dresser may be constructed as a dresser having a dressing surface formed at the underside of the peripheral edge portion thereof, and a cleaning device may be provided laterally of the polishing pad for spraying a cleaning liquid to the peripheral edge portion of the dresser positioned to shift off radially outward of the polishing pad, thereby cleaning the peripheral edge portion.

With the above construction, it is possible to clean the dressing surface formed at the underside of the peripheral edge portion of the dresser which is positioned to shift off radially outward of the polishing pad, and to prevent the dressing surface of the dresser from being clogged gradually during the dressing.

DESCRIPTION OF THE PREFERRED EMBODIMENT

One embodiment of an apparatus and a method for dressing a wafer polishing pad, according to the present invention, will be described below with reference to FIGS. 1 to 6.

Figure 1:
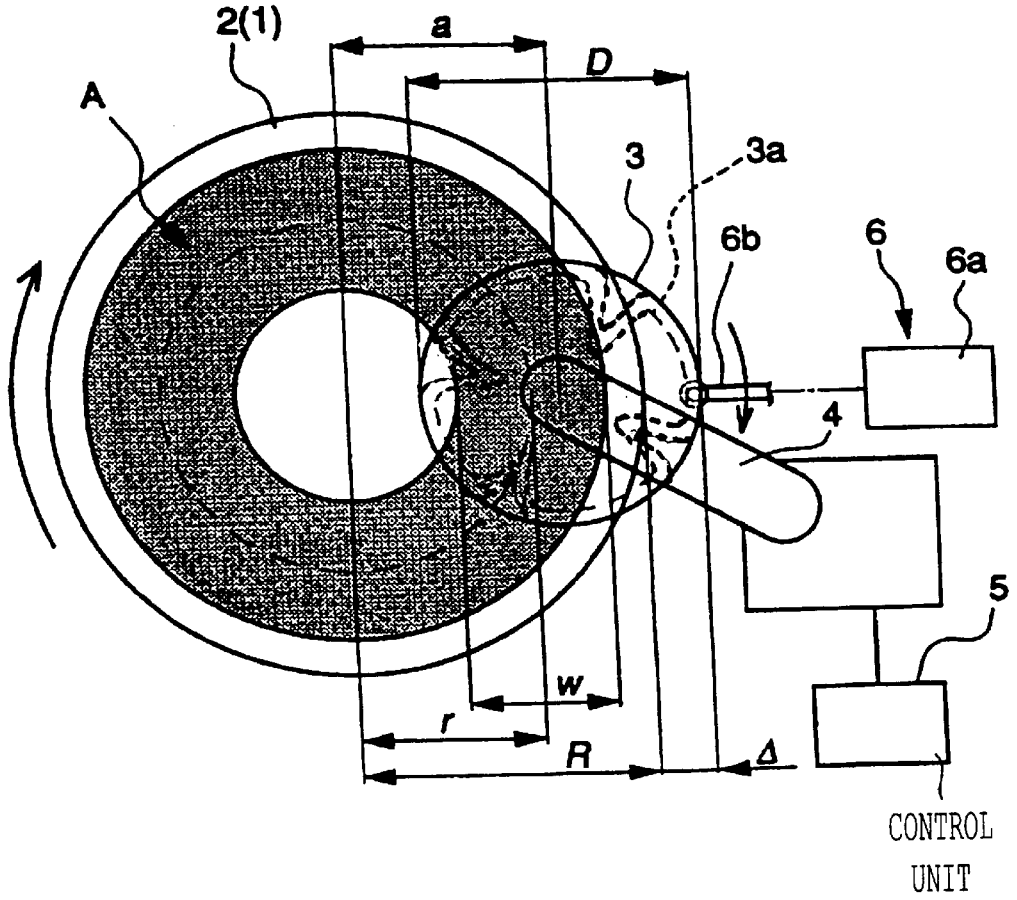
FIG. 1 is a schematic view showing the arrangement of a dresser and a cleaning device with respect to a polishing pad, the view showing an embodiment of the present invention.
Figure 8:
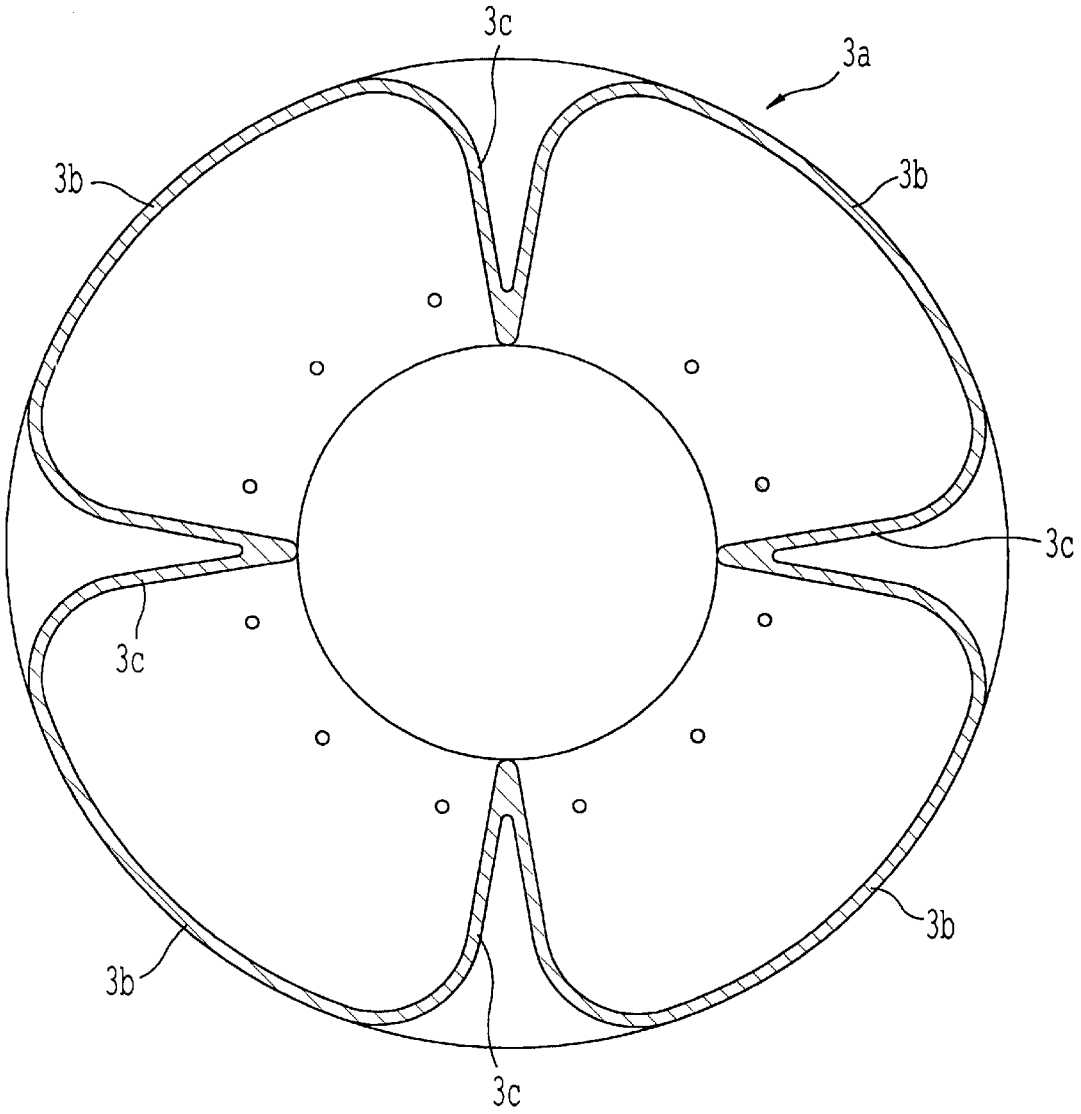
FIG. 8 is a plane view of a four-leaf clover shaped dressing surface.

Referring to FIG. 1, numeral 1 denotes a platen, 2 denotes a polishing pad, 3 denotes a dresser, 4 denotes an arm, 5 denotes a control unit, and 6 denotes a cleaning device. The polishing pad 2 is affixed onto the platen 1 in coaxially aligned relation, and is rotatable about its axis. The dresser 3 is supported by a fore end of the arm 4 rotatably in the circumferential direction with a dressing surface 3*a* facing downward. In this embodiment, the dresser 3 has a lower surface recessed on the inner peripheral side, and a dressing surface 3*a* is formed at the underside of a peripheral edge portion of the dresser 3. The dressing surface 3*a* has, for example, a four-leaf clover shape as shown in FIG. 8. Referring to FIG. 8, the four-leaf clover shape is formed, for example, by dividing a ring to four equivalent annular portions 3*b* which are combined by connection portions 3*c* which curve toward the center of the ring.

The control unit 5 controls operation of an arm elevating/lowering mechanism and an arm advancing/-retracting mechanism (both not shown) to move the dresser 3 in the vertical and horizontal directions toward or away from the polishing pad 2, whereby the dresser is arranged at a predetermined position. The cleaning device 6 includes a cleaning nozzle 6*b* provided laterally of the polishing pad 2 for spraying a cleaning liquid supplied from a cleaning liquid supply source 6*a*, i.e., pure water in this embodiment, to the peripheral edge portion of the dresser 3 (including the dressing surface 3*a*) which is positioned to shift off radially outward of the polishing pad 2 from an entirely overlapped relation.

Also, in FIG. 1, R represents a radius from the center to outer periphery of the polishing pad 2, w represents a radial width of the polishing pad 2 in an annular area (referred to as a dressed area) A that is to be dressed, r represents a radius from the center of the polishing pad 2 to the middle of the dressed area A, D represents an outer diameter of the dresser 3, and a represents the center-to-center distance between the polishing pad 2 and the dresser 3.

The sizes and set positions of the polishing pad 2 and the dresser 3 are determined so as to satisfy the following conditions for the purpose of dressing:

$$w \geqq D \quad \text{(II)}$$

$$|a-r| < (D-w)2| \quad \text{(III)}$$

$$R < a + D/2 \quad \text{(IV)}$$

$$D/2 < a \quad \text{(V)}$$

The above condition (II) must be satisfied to prevent any part of the dressed area A from remaining not dressed.

The above condition (III) must be satisfied to prevent the dresser 3 from displacing off the dressed area.

The above condition (IV) must be satisfied in order that the peripheral edge portion of the dresser 3 is positioned to shift off radially outward of the polishing pad 2 from an entirely overlapped relation.

The above condition (V) must be satisfied to prevent the peripheral edge portion of the dresser 3 from covering the center of the polishing pad 2.

A description is now made of a process of dressing the polishing pad 2 that has been used in the wafer polishing process.

After completion of the wafer polishing process, a wafer polishing head (not shown) holding a wafer is moved away from the polishing pad 2, and the dresser 3 supported by the arm 4 is now moved over the polishing pad 2.

At this time, the movement of the arm 4 is controlled by the control unit 5 and the dresser 3 is arranged so as to satisfy the above conditions (II), (III), (IV) and (V) while the dresser 3 is held in such a state as covering a part of the dressed area A across the width w thereof. Simultaneously, the peripheral edge portion of the dresser 3 is positioned to shift off a distance A radially outward of the polishing pad 2 from an entirely overlapped relation.

Figure 2:
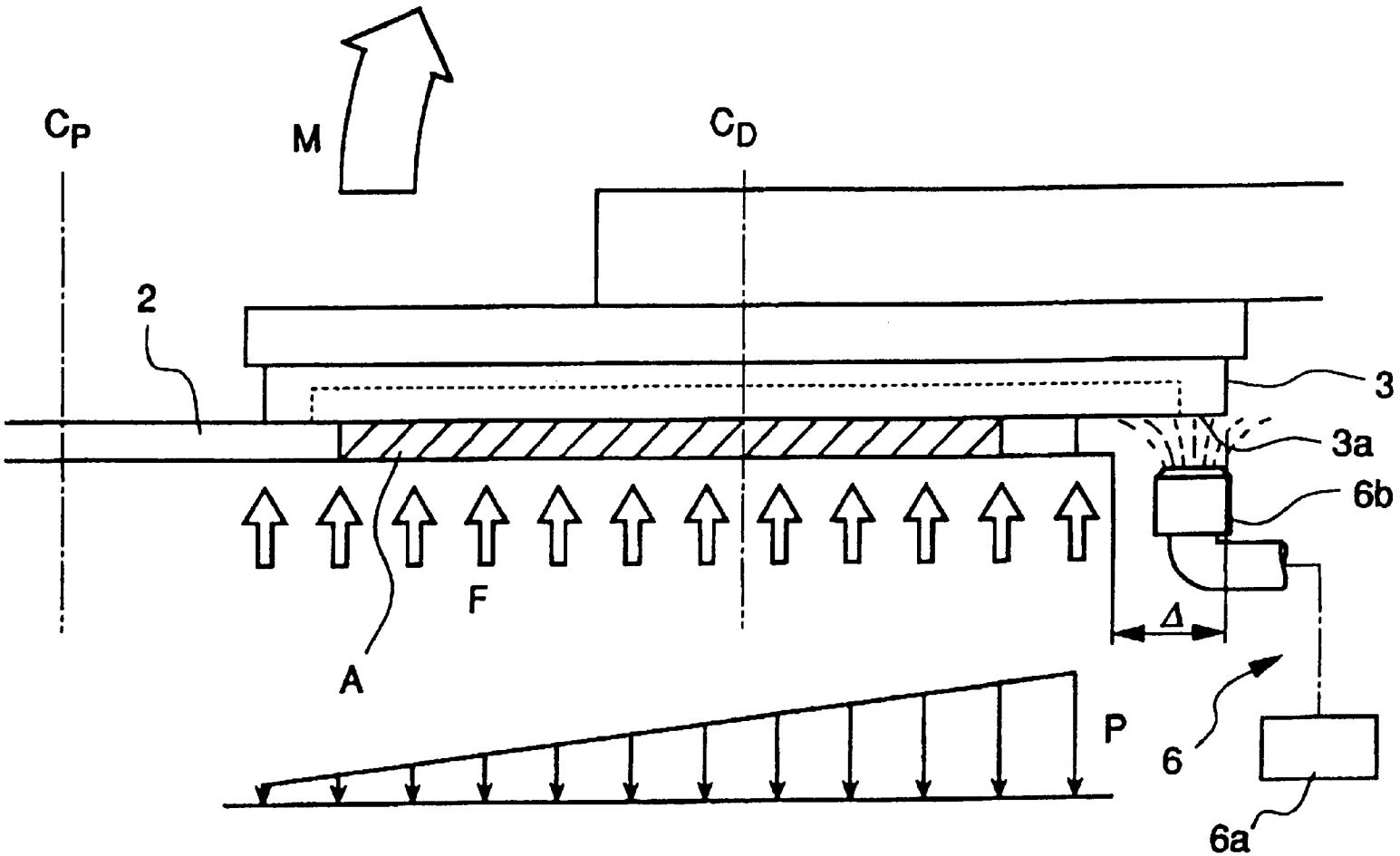
FIG. 2 is an explanatory view showing a balanced state of forces acting between the polishing pad and the dresser, and a state where the dresser is cleaned by the cleaning device.

By positioning the peripheral edge portion of the dresser 3 to shift off the distance Δ radially outward of the polishing pad 2, as shown in FIG. 2, one part of the dresser 3 that is positioned in contact with the pad surface on the radially inner side of the polishing pad 2 relative to the center $C_D$ of the dresser 3 becomes fairly greater than another part of the dresser 3 that is positioned in contact with the pad surface on the radially outer side of the polishing pad 2 relative to the center $C_D$ of the dresser 3. Reaction forces F acting upon the dresser 3 are therefore out of balance. This produces a moment M acting upon the dresser 3 to push the peripheral edge portion of the dresser 3, which is positioned on the side near the center $C_P$ of the polishing pad 2, upward in a vertical plane aligned with the radial direction of the polishing pad 2. As a result, under cooperation with the action of a ball joint provided between the arm 4 and the dresser 3, the dresser 3 is forced to incline slightly so as to raise the peripheral edge portion of the dresser 3 which is positioned on the center side of the polishing pad 2. With such an inclination of the dresser 3, a contact pressure P of the dresser 3 against the surface of the polishing pad 2 increases gradually toward the outer periphery from the center of the polishing pad 2.

When there occurs a plus gradient in distribution of the contact pressure P of the dresser 3 toward the outer periphery from the center of the polishing pad 2, the plus gradient cancels such an inherent characteristic of the dressing process that the dressed surface configuration of the polishing pad 2 exhibits a minus gradient toward the center from the outer periphery of the polishing pad 2. Accordingly, the amounts of dressing at various points in the radial direction of the polishing pad 2 exhibit values close to one another.

As the shift-off amount Δ of the dresser 3 is increased, the reaction forces acting upon the dresser 3 are out of balance to a larger extent and the dresser 3 is inclined at a greater angle. Correspondingly, the plus gradient in distribution of the contact pressure P becomes greater than required, and the polishing pad 2 is eventually excessively cut on the outer side. That mechanism can also be deduced from the above formula (I). In other words, by setting the shift-off amount Δ of the dresser 3 to a proper value, the amounts of dressing at various points in the radial direction of the polishing pad 2 exhibit a substantially constant value.

To find a proper value of the shift-off amount Δ, the dresser 3 was shifted step by step outward in the radial direction of the polishing pad 2, and a gradient of the dressing rate (amount of dressing per unit time) in the radially outward direction of the polishing pad 2 was measured at each value of the shift off amount Δ. Results of the measurement are plotted in FIG. 3. The measurement was carried out on condition of D=405 mm, R=450 mm, the rotational speed of the polishing pad 2 being 25 rpm, and the rotational speed of the dresser 3 being 25 rpm.

Figure 3:
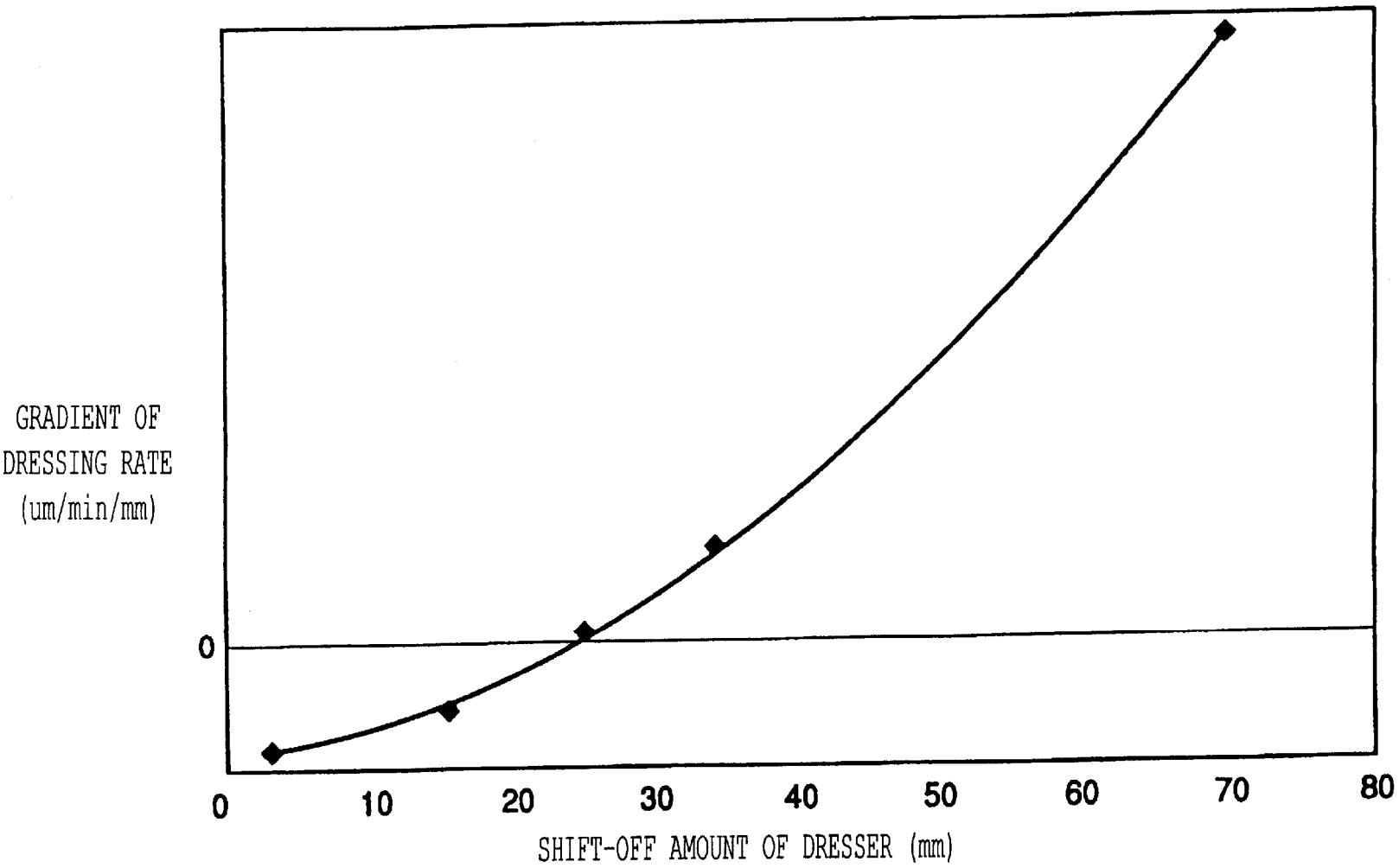
FIG. 3 is a graph showing a gradient of the dressing rate in the radially outward direction of the polishing pad at various shift-off amounts given to the dresser.

As seen from FIG. 3, when the shift-off amount Δ is set to 0 mm and 15 mm, the dressing rate exhibits a minus gradient in the radially outward direction because the dressing rate has a larger value on the inner peripheral side of the polishing pad 2 and a smaller value on the outer peripheral side thereof. When the shift-off amount Δ is set to 25 mm, the dressing rate is substantially uniform (no gradient) at various points in the radial direction of the polishing pad 2. Further, when the shift-off amount Δ is set to 35 mm and 70 mm, the dressing rate exhibits a plus gradient in the radially outward direction because the dressing rate has a smaller value on the inner peripheral side of the polishing pad 2 and a larger value on the outer peripheral side thereof.

Thus, it is understood that the proper shift-off amount Δ is approximately 25±2 mm in this embodiment. Stated otherwise, by setting the shift-off amount Δ to fall within the above range, a phenomenon of inner-side or outer-side excessive cutting of the polishing pad 2 can be avoided from progressing gradually, and the amount of dressing can be kept uniform at various points in the radial direction of the polishing pad 2.

Figure 4:
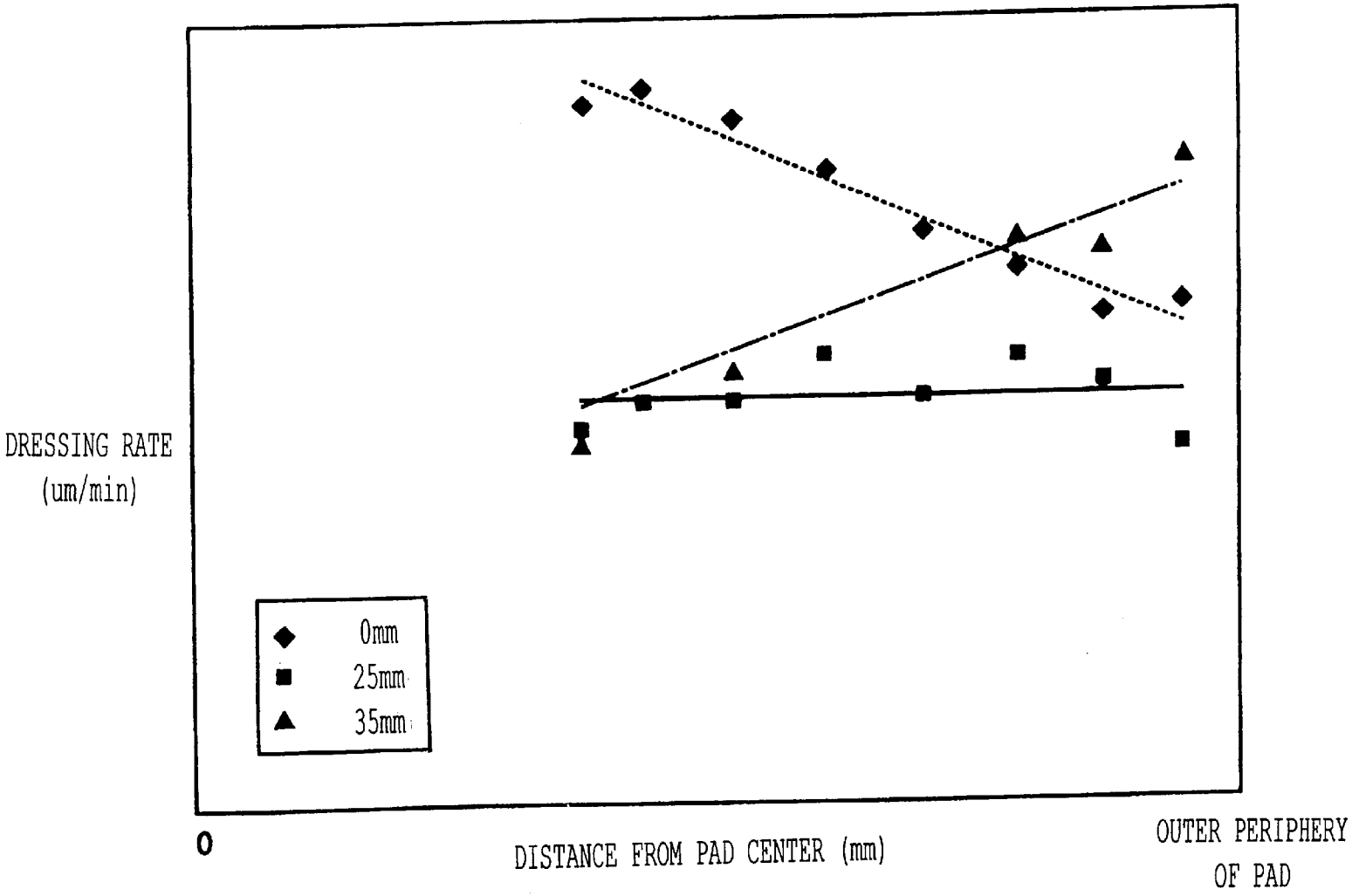
FIG. 4 is a graph showing differences in distribution of the dressing rate on the surface of the polishing pad at various shift-off amounts Δ of the dresser when the shift-off amount is set to values of 0 mm, 25 mm and 35 mm.

FIG. 4 shows results of measuring dressing rates on the surface of the polishing pad 2 at various shift-off amounts Δ of the dresser 3 when the shift-off amount Δ is set to values of 0 mm, 25 mm and 35 mm. In a graph of FIG. 4, the horizontal axis represents the distance from the center of the polishing pad 2, and the vertical axis represents the dressing rate.

As seen from FIG. 4, when the shift-off amount Δ is set to 0 mm, the dressing rate on the surface of the polishing pad 2 exhibits a minus gradient in the radially outward direction and a phenomenon of inner-side excessive cutting occurs. When the shift-off amount Δ is set to 25 mm, the dressing rate is substantially uniform at various points in the radial direction of the polishing pad 2. Further, when the shift-off amount Δ is set to 35 mm, the dressing rate on the surface of the polishing pad 2 exhibits a plus gradient in the radially outward direction and a phenomenon of outer-side excessive cutting occurs.

Figure 5:
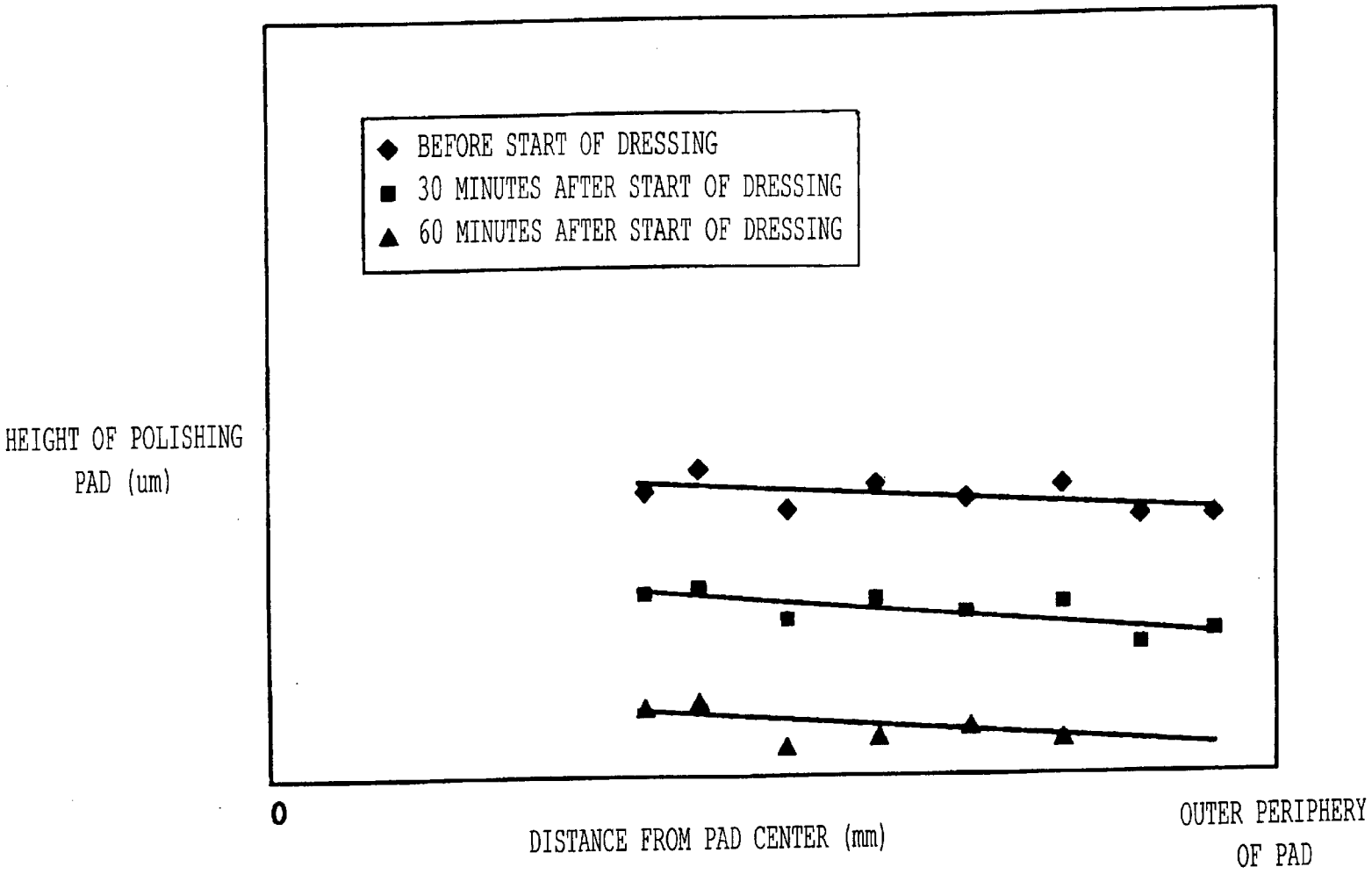
FIG. 5 is a graph showing a surface level difference of the polishing pad after the lapse of certain periods of time on condition that the shift-off amount of the dresser is set to 25 mm which seems to be an optimum value.

Next, FIG. 5 shows results of measuring a surface level difference of the polishing pad 2 after the lapse of certain periods of time on condition that the shift-off amount Δ of the dresser 3 is set to 25 mm which seems to be an optimum value. In a graph of FIG. 5, the horizontal axis represents the distance from the center of the polishing pad 2, and the vertical axis represents the height of the polishing pad 2 from the upper surface of the platen 1. The measurement was carried out before the start of dressing and after the lapse of 30 minutes and 60 minutes from the start of dressing on condition that some status of the polishing pad in arbitrary stage was set to the pad status before the start of dressing.

As seen from FIG. 5, the surface of the polishing pad 2 exhibits a slight minus gradient in the radially outward direction, but the gradient is hardly changed over a period spanning from the time before the start of dressing to the time after the dressing continues for 30 minutes and then 60 minutes. From these results, it is understood that the surface configuration of the polishing pad 2 can be kept constant even after repeating the dressing.

Figure 6:
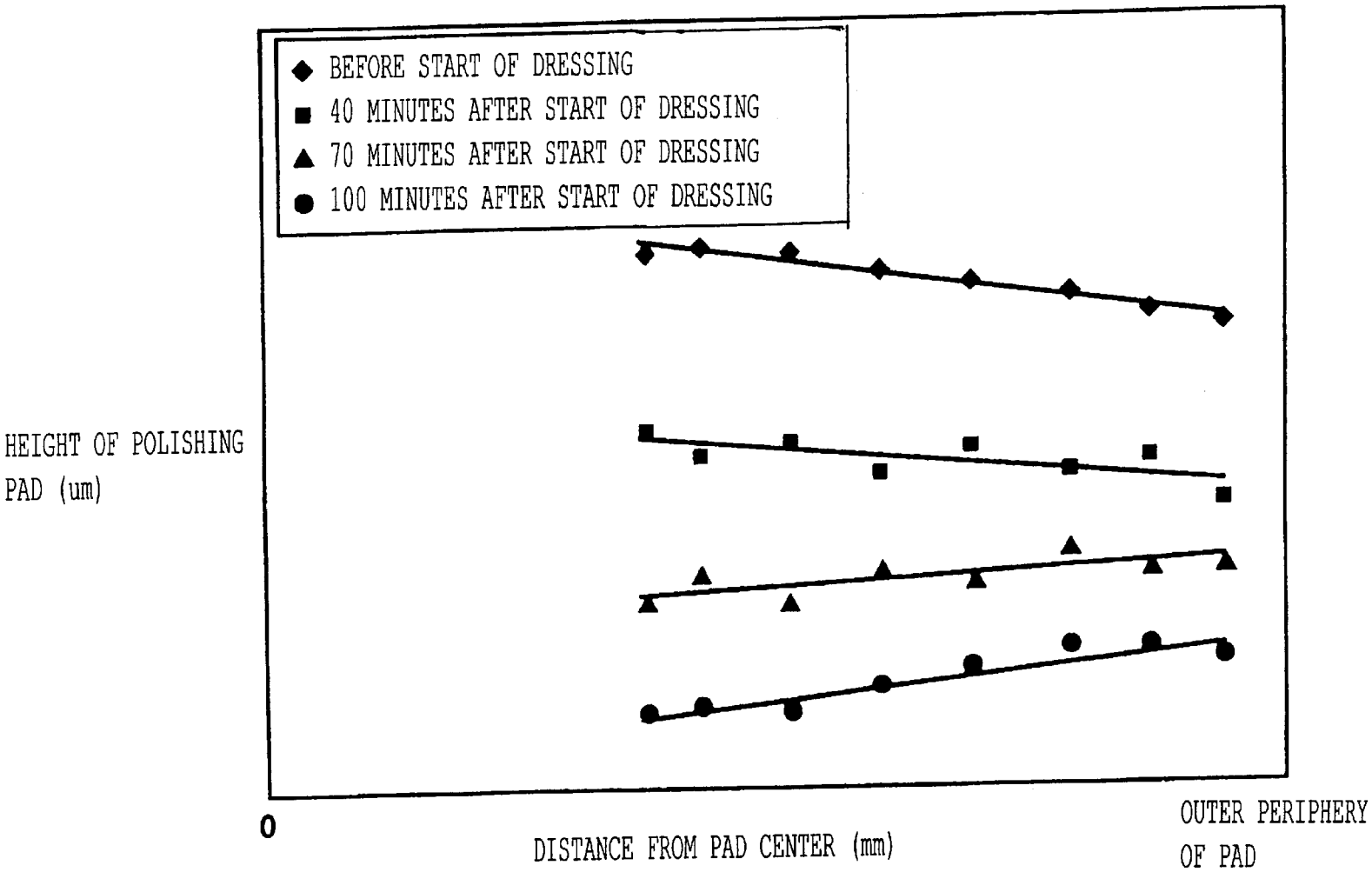
FIG. 6 is a graph showing a surface level difference of the polishing pad after the lapse of certain periods of time on condition that the dresser is arranged not to shift off with respect to the polishing pad.
Figure 7:
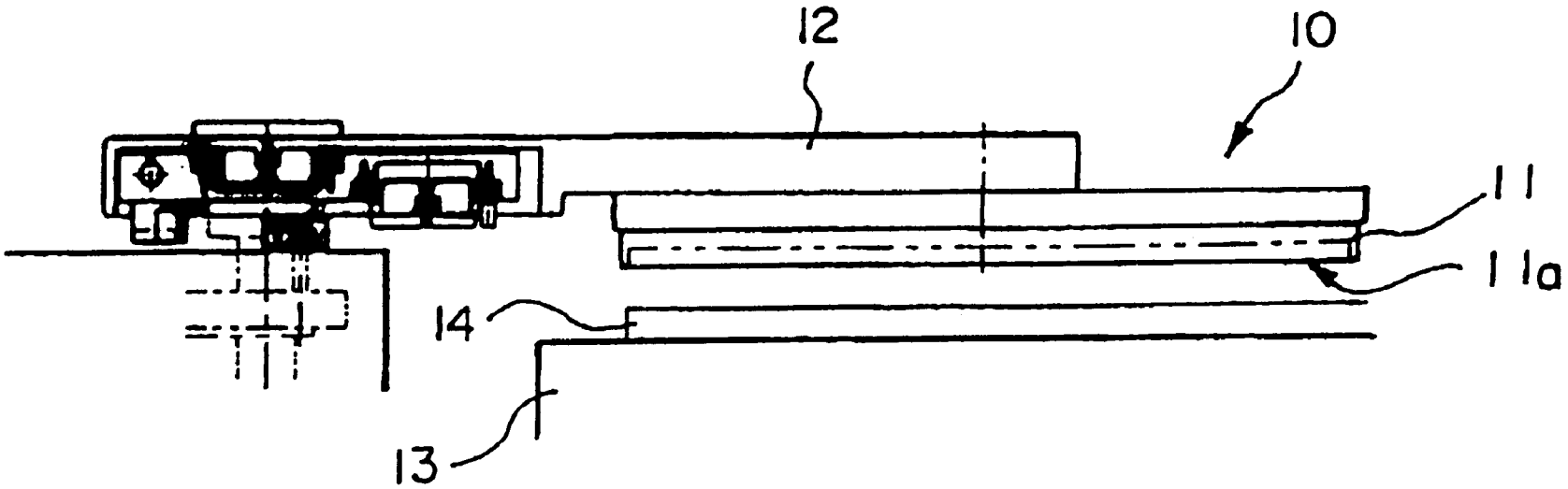
FIG. 7 is a side sectional view showing the construction of a conventional dressing apparatus.

For comparison with the results of FIG. 5, FIG. 6 shows results of measuring a surface level difference of the polishing pad 2 after the lapse of certain periods of time on condition that the dresser 3 is arranged not to shift off with respect to the polishing pad (i.e., the shift-off amount Δ is set to 0 mm). The measurement was carried out before the start of dressing and after the lapse of 40 minutes, 70 minutes and 100 minutes from the start of dressing on condition that some status of the polishing pad in arbitrary stage was set to the pad status before the start of dressing.

As seen from FIG. 6, before the start of dressing, the surface of the polishing pad 2 exhibits a minus gradient in the radially outward direction. After the lapse of 40 minutes, however, the surface of the polishing pad 2 is leveled substantially flat although it still exhibits a slight minus gradient. Then, after the lapse of 70 minutes from the start of dressing, the surface of the polishing pad 2 exhibits a plus gradient in the radially outward direction. After the lapse of 100 minutes, the plus gradient is further increased and it is understood that a phenomenon of outer-side excessive cutting apparently occurs.

During the dressing of the polishing pad 2, the dressing surface 3*a* of the dresser 3, which is rotated in a state lying off with respect to the polishing pad 2 by the proper shift off amount as described above, is cleaned by pure water ejected through the cleaning nozzle 6*b* of the cleaning device 6 (see FIG. 2).

With the above cleaning, the dressing surface 3*a* of the dresser 3 can be prevented from being clogged with pad chippings and slurry particles accumulated during the dressing. Therefore, the amount by which the polishing pad 2 is dressed can be held uniform even during the dressing, and the machining accuracy of a wafer polished by the polishing pad 2 can be improved.

In the above embodiment, the dresser 3 has the lower surface recessed on the inner peripheral side, and the dressing surface 3*a* is formed at the underside of the peripheral edge portion of the dresser 3. However, the dresser is not limited to such a configuration if there is no need of cleaning the dresser 3. In that case, the lower surface of the dresser 3 may be formed flat or to have a complicated pattern, and the dressing surface 3*a* may be formed over the entirely or just in a part of the lower surface of the dresser 3.

Figure 9:
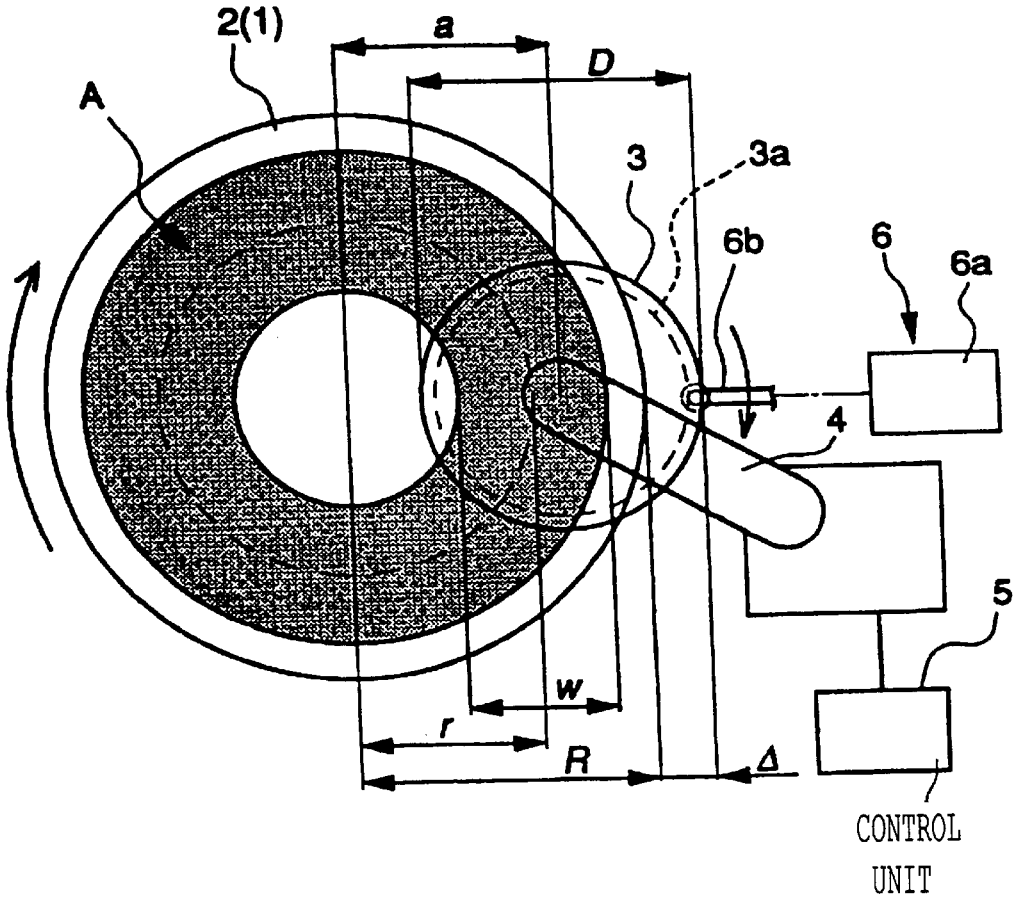
FIG. 9 is a schematic view showing the arrangement of a dresser and a cleaning device with respect to a polishing pad, the view showing another embodiment of the present invention.

FIG. 9 shows another embodiment. Referring to FIG. 9, the dressing surface 3*a* has a ring shape.

Figure 10:
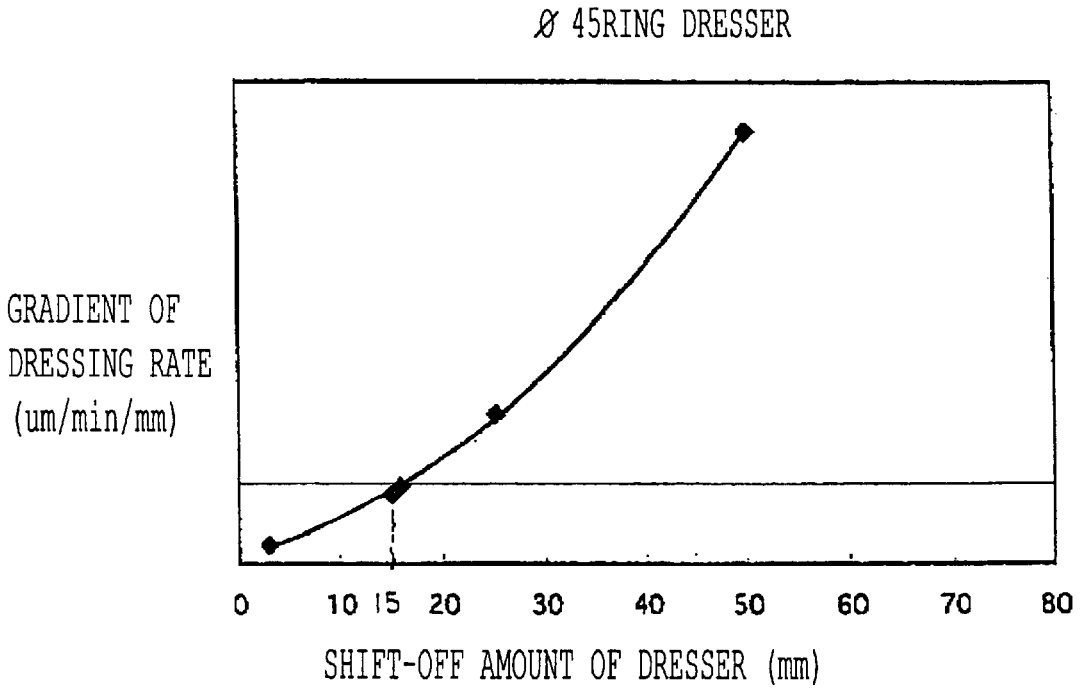
FIG. 10 is a graph showing a gradient of the dressing rate in the radially outward direction of the polishing pad at various shift-off amounts given to the dresser.

FIG. 10 is a graph similar to FIG. 3 which shows a gradient of the dressing rate in the radially outward direction of the polishing pad at various shift-off amounts given to the dresser. In this example, the ring-shaped dressing surface 3*a* is used. The measurement was carried out on condition of D=405 mm, R=450 mm, the rotational speed of the polishing pad 2 being 25 rpm, and the rotational speed of the dresser 3 being 25 rpm. As seen from FIG. 10, when the shift-off amount Δ is set to 15 mm, the dressing rate is substantially uniform (no gradient) at various points in the radial direction of the polishing pad 2. Thus, it is understood that the proper shift-off amount Δ is approximately 15±2 mm in this embodiment.

According to the present invention, as described above, since the peripheral edge portion of the dresser is arranged to shift off a predetermined distance radially outward of the polishing pad from an entirely overlapped relation, there occurs a plus gradient in distribution of the contact pressure applied by the dresser in the direction toward the outer periphery from the center of the polishing pad, and this plus gradient cancels such an inherent characteristic of the dressing process that the dressed surface configuration of the polishing pad 2 exhibits a minus gradient toward the center from the outer periphery of the polishing pad. It is therefore possible to keep uniform the amount by which the polishing pad is dressed at various points in the radial direction thereof, to avoid a phenomenon of inner-side or outer-side excessive cutting of the polishing pad from progressing gradually, and to improve uniformity in each wafer polishing process.

Also, according to the present invention, when the initial surface configuration of the polishing pad is not flat and has a gradient, this situation can be dealt with as follows. More specifically, for example, when the pad surface has a plus gradient toward the center from the outer periphery of the polishing pad, the dressing is performed by setting the shift-off amount of the dresser to a smaller value than the optimum one. When the pad surface has a minus gradient toward the center from the outer periphery of the polishing pad, the dressing is performed by setting the shift-off amount of the dresser to a larger value than the optimum one. By so setting the shift-off amount, the flat surface configuration of the polishing pad free from a gradient can be obtained in any case. Subsequently, the dressing is performed by setting the shift-off amount of the dresser to the optimum value. As a result, uniformity can be improved not only in each wafer polishing process but also in wafer polishing itself.

Further, according to the present invention, since the dressing surface of the dresser can be prevented from being clogged gradually during the dressing, the amount by which the polishing pad is dressed can be held uniform even during the dressing, and the machining accuracy of a wafer polished by the polishing pad can be improved.

Additionally, the dressing apparatus of the above embodiment has been described as being of the type that the dresser is pressed against the rotating polishing pad to rotate due to frictional force generated between the dresser and the polishing pad. As a matter of course, however, similar advantages as described above can also be obtained with a dressing apparatus of another type, for example, controlling the rotational speed of the dresser by a motor or the like.

What is claimed is:

1. An apparatus for dressing a wafer polishing pad, comprising:

a disk-shaped dresser configured to be pressed against the polishing pad which rotates in a circumferential direction, said dresser being configured to rotate in a same direction as said polishing pad rotates due to frictional force generated between said dresser and said polishing pad;

an arm configured to support said dresser rotatably and to press said dresser against said polishing pad; and a control unit configured to control said arm to position the dresser such that a peripheral edge portion of said dresser is positioned outside a peripheral edge portion of said polishing pad by a predetermined distance.

2. An apparatus for dressing a wafer polishing pad according to claim 1, further comprising:

a cleaning device configured to spray a cleaning liquid to the peripheral edge portion of said dresser which is positioned outside the peripheral edge portion of said polishing pad, said dresser including a dressing surface formed at the peripheral edge portion of said dresser on a side configured to face the polishing pad.

3. A method for dressing a wafer polishing pad, comprising:

pressing a disk-shaped dresser against the polishing pad which rotates in a circumferential direction, said dresser being configured to rotate in a same direction as said polishing pad rotates due to frictional force generated between said dresser and said polishing pad; and controlling a position of the dresser such that a peripheral edge portion of said dresser is positioned outside a peripheral edge portion of said polishing pad by a predetermined distance.

4. A method for dressing a wafer polishing pad according to claim 3, further comprising:

forming a dressing surface at the peripheral edge portion of said dresser on a side configured to face the polishing pad; and spraying a cleaning liquid to the dressing surface of said dresser which is positioned outside of the peripheral edge portion of said polishing pad.

* * * * *